US005362317A

United States Patent [19]

Patel et al.

[11] Patent Number: 5,362,317

[45] Date of Patent: Nov. 8, 1994

[54] SEALANT COMPOSITIONS AND PROCESS FOR SEALING ALUMINUM OXIDE FILMS

[75] Inventors: Pinakin Patel, Fort Mill, S.C.; Richard L. Ranieri, Charlotte, N.C.

[73] Assignee: Sandoz Ltd., Basel, Switzerland

[21] Appl. No.: 92,377

[22] Filed: Jul. 15, 1993

Related U.S. Application Data

[63] Continuation of Ser. No. 682,757, Apr. 9, 1991, abandoned.

[51] Int. Cl.[5] ..... C09D 1/00; C09K 15/12

[52] U.S. Cl. ..... 106/287.23; 562/75; 562/88

[58] Field of Search ..... 106/287.23; 562/75, 562/88

[56] References Cited

U.S. PATENT DOCUMENTS

| | | | |
|---|---|---|---|
| 2,671,815 | 3/1954 | Pines et al. | 562/88 |
| 2,739,124 | 3/1956 | Otto | 562/88 |
| 2,854,477 | 9/1958 | Steinhauer | 260/512 |
| 3,264,242 | 8/1966 | Teot | 562/75 |
| 4,531,979 | 7/1985 | Bohler et al. | 148/6.27 |
| 4,588,448 | 5/1986 | Baumann et al. | 148/6.27 |

FOREIGN PATENT DOCUMENTS

| | | | |
|---|---|---|---|
| 122129A2 | 10/1984 | European Pat. Off. | C25D 11/24 |
| 122129 | 10/1984 | European Pat. Off. | C25D 11/24 |
| 57-54593 | 11/1982 | Japan | 106/287.23 |

*Primary Examiner*—David Brunsman

*Attorney, Agent, or Firm*—Robert S. Honor; Richard E. Vila; Diane E. Furman

[57] ABSTRACT

Aluminum oxide sealant compositions, concentrates, and processes employing the same are described which comprise an alkaline earth metal salt and certain sulfonated compounds. Unexpected improvements in seal quality are obtained using the compositions of the invention, and in the substantial absence of smut formation. Advantageously, the aqueous sealant compositions of the invention may be cobalt and nickel-free, can be prepared from tap water, and can be employed at temperatures below the boiling point.

33 Claims, No Drawings

SEALANT COMPOSITIONS AND PROCESS FOR SEALING ALUMINUM OXIDE FILMS

This is a continuation of application Ser. No. 07/682,757, filed Apr. 9, 1991 now abandoned.

FIELD OF THE INVENTION

The present invention relates to sealant compositions and their use in treatments of aluminum oxide films. In particular, the invention relates to compositions which provide an effective seal of aluminum and which also prevent or minimize formation of smut deposits during sealing; to concentrates for preparing the sealant compositions; and to sealing processes employing the same.

BACKGROUND OF THE INVENTION

Aluminum or aluminum alloy (hereinafter collectively referred to as "aluminum") is often surface treated to improve its hardness and resistance to corrosion, as well as to provide a substrate for depositing organic dyes or inorganic metal salts. Such treatments generally involve laying down a porous film or coating of adherent aluminum oxide on the aluminum surface, typically by direct current anodizing of the aluminum in an aqueous strong acid electrolyte, although other techniques and electrolytes are available. However, the aluminum oxide films because of their porosity remain somewhat vulnerable to corrosion, leaching of colorant or other deterioration; and in general must be "sealed" or the pores otherwise protected, for the films to be completely useful, particularly if employed, for example, in architectural uses.

Sealing has traditionally been carried out as a hydrothermal process in which the porous, essentially anhydrous aluminum oxide film is immersed in an aqueous bath maintained at a temperature at or near the boiling point, to result in the formation of hydrated aluminum oxide compounds such as boehmite. The formed hydrated compounds are believed to cause a constriction or blockage of the pores of the aluminum oxide film, producing the observed sealant effect.

A generally accepted measure of seal quality is "acid dissolution test" (ADT) weight loss, i.e. the weight loss resulting from exposure of the sealed aluminum oxide film to a dilute acid solution, typically at 100° F. for 15 minutes. Most commercial applications require a "high quality" seal, by which is commonly meant seal characterized by an ADT weight loss of about 3 mg./in.$^2$ or less, and preferably about 2 mg./in.$^2$ or less.

Demineralized water at or near the boiling point has traditionally been used to make up sealing baths. Acceptable quality seal has also been obtained from ordinary tap water baths and at somewhat reduced temperatures, e.g., about 160°–190° F., by the addition of various additives to the bath, in particular, soluble salts of divalent metals, especially cobalt or nickel acetate.

However, a recognized limitation associated with aqueous sealant compositions or water per se as steam or hot water to seal anodized aluminum is the tendency for residual hydrated aluminum oxide crystals to deposit as "smudge" or "smut" on the aluminum oxide surface, often seriously detracting from its appearance. Chemical and mechanical desmutting after-treatments introduce an added expense and may themselves adversely affect seal quality.

Accordingly it has been a longstanding object in the art to prevent or minimize initial formation of smut during the sealing operation, without detracting from seal quality.

It has also become an important objective in the industry to reduce or eliminate potentially environmentally hazardous effluent from aluminum finishing processes, and it has been of particular interest to develop cobalt- and nickel-free aqueous sealant compositions for sealing aluminum oxide coatings.

It is therefore an objective to identify aqueous sealant compositions, concentrates for preparing the compositions, and processes for using the same, which are free of added cobalt or nickel and provide high quality seal, i.e. characterized by an ADT weight loss of about 3 mg./in.$^2$ or less and preferably about 2 mg./in.$^2$ or less.

It is a further object to obtain high quality seal in the substantial absence of smut formation.

It is another objective to identify aqueous sealant compositions which are effective at reduced temperatures, i.e. below the boiling point.

SUMMARY OF THE INVENTION

Novel aqueous sealant compositions and concentrates have been developed which provide high quality seal of clear or dyed aluminum oxide films and have anti-smutting properties.

The compositions of the invention may be free of added nickel or cobalt and therefore are less objectionable from an environmental standpoint than certain prior art compositions.

Further advantageously, the compositions of the invention may be prepared from tap water and may be satisfactorily employed for sealing at temperatures below the boiling point.

The compositions of the invention comprise: (a) at least one alkaline earth metal salt; and (b) at least one compound having the following formula I:

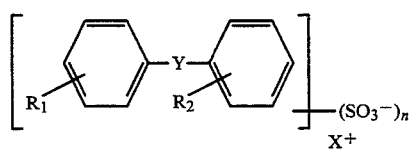

I wherein Y is a direct bond or a group of formula:

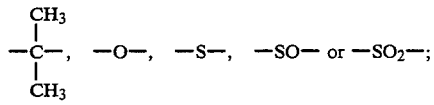

$R_1$ and $R_2$ are each individually selected from H or $C_5$–$C_{25}$alkyl, provided that $R_1$ and $R_2$ may not both be H;

n has a value in the range of 1 to 4;

x is a counterion, such as $H^+$ or an alkali metal ion, preferably $Na^+$.

Soluble salts of divalent metals which form clear solutions, including salts of alkaline earth metals, have been provided for various purposes to sealing compositions known to the art. Various sulfonated compounds have also been employed in sealing baths, see, e.g., EP 122,129 (Albright & Wilson Ltd.).

It has been found in accordance with the invention that certain aqueous solutions comprising a compound of formula I and an alkaline earth metal salt are particularly useful as sealant compositions.

More particularly, we have found that very good sealant compositions are provided by aqueous solutions of at least one alkaline earth metal salt and at least one compound of the formula I in the molar ratio of about 2:1 to 20:1.

Advantageously, sealant concentrates according to the invention can be diluted to form sealing bath solutions, and when the molar ratios of the components are adjusted to be within the indicated range, the sealing solutions are substantially free from the cloudinesss which we have observed in connection with certain prior art compositions when diluted from the concentrate into sealing baths.

Furthermore, the resulting aqueous compositions provide substantial improvements in seal quality, to an extent which is more than simply additive of the individual sealant effects of either the alkaline earth metal component or the sulfonated compound. This apparent synergism in sealant effect obtained by combining an alkaline earth metal salt and a sulfonated compound of formula I has been observed over a range of total concentrations of these components in the sealing bath, and occurs in the substantial absence of smut formation.

By "substantial absence" of smut is meant the absence of visually detectable smut (while not excluding the occurrence of isolated crystals not readily detectable by visual inspection).

To our knowledge there has been no prior recognition of the enhanced sealant properties and the anti-smutting action exhibited by the particular compositions and concentrates of the invention. Such compositions are clear solutions and are substantially free of cloudiness or turbidity which can be deleterious in sealing operations.

DETAILED DESCRIPTION OF THE INVENTION

The aluminum oxide films which are to be sealed employing the compositions and process of the invention may be prepared in various ways. Conventionally, the aluminum is anodized by passing direct current to the aluminum workpiece as the anode in an aqueous acidic electrolyte. Sulfuric acid is typically the preferred electrolyte to provide anodic oxide coating of suitable thickness, corrosion resistance and adaptability for coloring, for most commercial applications. In order to fully benefit from the smut-inhibiting characteristic of the compositions of the invention, anodizing should preferably be carried out at about 12 to 25 ASF within a temperature range of about 65° to 75° C. in a 15 to 22 wt. % sulfuric acid electrolyte.

Other electrolyzing conditions and acids (e.g., phosphoric, oxalic, chromic, and mixtures thereof) are well-known to the art and may also be employed in various cases to provide oxide film of a given hardness, thickness, etc.

The sealant compositions and concentrates of the invention are aqueous solutions which comprise at least one soluble alkaline earth metal salt and at least one compound of formula I as earlier described.

The alkaline earth metal may be selected from Be, Mg, Ca, Sr, Ba and mixtures thereof, and is desirably selected from magnesium, calcium and mixtures thereof.

Suitable salts of the alkaline earth metal ion include, without limitation, acetates, sulfates, hydroxides, nitrates, halides, phosphates and sulfamates, and mixtures thereof. Anions which can contribute a buffering effect are usually preferred and in this respect and others the acetate salt is the more preferred salt.

Compounds of formula I are known per se or can be prepared from known materials by established procedures. The compounds have known surfactant properties and are commercially available, generally as a formulation which may comprise a mixture of such compounds, particularly a mixture of mono-alkylated (i.e. where one of $R_1$ and $R_2$ is H) and di-alkylated (i.e. where neither $R_1$ nor $R_2$ is H) compounds.

Therefore, a "compound" of Formula I shall be understood to include mixtures of compounds having the above-described formula I, particularly mixtures of mono- and di-alkylated compounds.

Of the compounds of formula I of the invention (also referred to hereinafter as "compounds I"), preferred compounds I comprise those being defined by the following:

(i) Y is O ; n is 1 or 2; and $R_1$ and $R_2$ are each para to the Y group.

More preferred compounds I comprise those defined by paragraph (i) above, wherein:

(ii) at least one of $R_1$ and $R_2$ is $C_{12}$–$C_{20}$alkyl, and the sulfonate group or groups is ortho to the Y group.

Most preferred are the compounds I of paragraph (ii) above, wherein:

(iii) n is 2 and at least one of $R_1$ and $R_2$ is $C_{14-16}$alkyl, preferably $C_{16}$alkyl. Of these preferred compounds, mixtures comprising about 80% mono-alkylated (i.e. where one of $R_1$ and $R_2$ is $C_{16}$alkyl and the other is H) to about 20% di-alkylated (i.e. where both $R_1$ and $R_2$ are $C_{16}$alkyl) of such compounds have proved particularly useful.

In the abovementioned preferred compounds, $X^+$ is preferably $Na^+$.

Compounds I are generally available in the form of their sodium salts, but may also be provided to the sealant composition in the form of the free acid or other salt.

In the compositions of the invention the molar ratio of the alkaline earth metal salt to the compound of formula I is preferably about 2:1 to about 20:1, more preferably 4:1 to 20:1, and most preferably about 10:1 to 16:1.

The weight ratio of the alkaline earth metal salt to the compound of formula I is from about 0.1:1 to 30:1, preferably about 0.5:1 to 15:1, more preferably about 1:1 to 10:1, and most preferably about 3:1 to 5:1.

The total combined concentration in the sealing composition of the alkaline earth metal salt and the compound of formula I can be about 1 to 25 g/l, although higher concentrations may be employed as needed to produce the desired sealant effect, and is preferably about 2 to 10 g/l.

The sealant compositions of the invention may be formed by combining the alkaline earth metal salt and the compound of formula I in demineralized water or in tap water. For convenience, a sealant concentrate may first be formed which comprises a concentrated aqueous solution (i.e. having a water concentration below about 40%) of the compound of formula I and the metal salt and any optional components; and the concentrate may then be diluted into an aqueous sealant bath to form a sealant composition of the invention. For example, compounds of formula I are generally available as aqueous solutions thereof (e.g., an aqueous 45% solution of the compounds), and concentrates according to the invention may be formed by simply adding an alkali metal earth salt as a solid to such a solution. Suitable aqueous concentrates may contain 400–800 grams/liter of the combined alkali earth metal salt and compound of formula I, more usually 600–750 grams/liter, e.g. a suitable aqueous concentrate contains 700 grams per liter of the combination. The concentrates are believed to be novel and comprise another aspect of the invention. Hence, compositions provided to the invention may comprise up to 800 grams/liter of the alkaline earth metal salt and compound I.

An advantage of the present compositions and process is that a sealant composition or concentrate according to the invention which comprises tap water may be employed over an extended period of time without foregoing the benefits of the invention, resulting in a cost savings relative to processes which require demineralized water.

The sealant compositions per se may be formulated within a broad pH range such as may facilitate handling or the like, and the compositions when employed for sealing are maintained a pH sufficiently high to promote effective sealing but below a value at which results in substantial smut formation and/or precipitation of the components of the sealing composition. Usually, the pH will range from between about 4.0 to 8.0, more usually 4.5 to 7.5. A pH value within the range of about about 7 to 8 will provide more effective sealing, but sealing may also be carried at lower ranges. pH adjustments can be made by adding either acetic acid or sodium hydroxide to make the bath more acid or alkaline. An advantage of the invention is that the pH of the sealant composition can be readily made stable over an extended period of time, and consequently frequent readjustment of pH is generally not required. For example, an acetate salt of an alkaline earth metal provides a buffering action which can be enhanced by minor addition of acetic acid.

The sealant bath may contain other conventional additives such as, e.g., wetting agents, buffering agents, defoaming agents, etc.

Employing the aqueous compositions of the invention, it is possible to obtain high quality seal at temperatures at or well below the boiling point, i.e. in a range of about 160° F. to 212° F. and preferably about 160 to 180° F.

The aluminum oxide surface is immersed in the sealant bath for a suitable length of time to accomplish the sealing, depending on the thickness of the oxide film.

The process parameters for sealing are mutually dependent, in that a shortened immersion time will generally require an elevation of temperature and/or higher pH.

A conventional water rinse is employed after sealing to remove any chemical residue and to facilitate drying.

The sealing process of the invention can be employed in connection with both clear and colored anodized aluminum as well as in batch or continuous operations.

The term "aluminum" as used herein shall be understood to include pure aluminum as well as aluminum base alloys containing at least 50% by weight aluminum. The aluminum surface can be of any desired shape or form suitable for the oxidizing and sealing operations contemplated by the invention, including extruded, drawn, machined or rolled shapes and forms.

The following examples are provided for purposes of illustration and not for limitation of the practice of the invention in the formation of sealing compositions and concentrates and the use of same in sealing aluminum oxide surfaces.

Aluminum coupons measuring 2 in.×3 in. are degreased, etched with an alkaline cleaner and washed, then anodically oxidized at 15 ASF in an aqueous 18 wt. % sulfuric acid bath at 68°–70° F. for 35 minutes, resulting in an anodic oxide layer of about 15–20 microns, and therafter are rinsed with demineralized water.

The coupons are then immersed for 15 minutes in a demineralized water sealant bath, pH 5.7, at 180° F.

In the following examples and comparative examples, the aqueous sealant bath comprises an alkaline earth metal salt (as identified on the following Tables I and II) and/or a compound of formula I (referred to as "I") in the respective concentrations in grams per liter of sealant bath and molar ratios also listed on the Tables.

The compound of formula I is provided to the sealant bath as an aqueous 35% solution of compounds having the following formula:

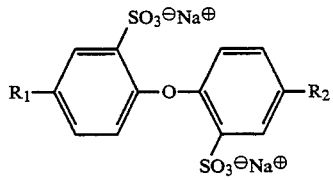

wherein each of $R_1$ and $R_2$ is either H or $C_{16}$alkyl, provided that $R_1$ and $R_2$ may not both be H.

More particularly, the compound I used in the examples comprises a mixture of monoalkylated (i.e. where one of $R_1$ and $R_2$ is $C_{16}$alkyl and the other is H) and dialkylated (i.e. where both $R_1$ and $R_2$ are $C_{16}$alkyl) compounds in a weight percent ratio of about 80:20.

The coupons are recovered and rinsed with tap water, and subjected to an acid dissolution test (ASTM No. B680-80), which is carried out by weighing the sealed anodized aluminum strip, then immersing the strip for 15 minutes in a solution of 2.0 wt. % chromic acid and 3.5 wt. % phosphoric acid at 100° F., recovering and re-weighing the strip, and calculating the weight loss in mg/in$^2$.

The following Tables I and II show the ADT weight loss of the anodized aluminum coupons treated by the above-described sealing compositions and procedure.

Examples 1–3 and accompanying Comparative Examples 1(a), 1(b), 2(a), 2(b), and 3(a) and 3(b) demonstrate the enhanced sealant effect, as measured by ADT weight loss, obtained employing the sealing compositions of the invention, relative to aqueous compositions comprising either an alkaline earth metal salt or a compound of formula I.

Examples 4–7 demonstrate that high quality seal can be obtained using the compositions of the invention comprising various concentrations and ratios of the compound of formula I and the alkaline earth metal salt.

The aluminum strips obtained in Examples 1–7 were determined by visual inspection to be substantially smut-free.

The results indicate that substantial improvements in seal quality, to an extent which is more than additive, can be obtained by employing a sealant composition comprising the particular combination of a source of an alkaline earth metal ion and at least one compound of formula I of the invention.

The results also indicate that high quality seal can be obtained using cobalt- and nickel-free compositions.

TABLE I

| | Sealant Composition | Amount (g/l) | Molar ratio[1] | ADT Wt. Loss mg./in.$^2$ |
|---|---|---|---|---|
| Example 1 | Ca(OAc)2 | 0.5 | | |
| | I | 0.5 | | |
| | TOTAL | 1.0 | 4.1 | 7 |
| Comparative Example | | | | |
| 1(a) | Ca(OAc)2 | 1.0 | | 11 |
| 1(b) | I | 1.0 | | 18 |
| Example 2 | Mg(OAc)2 | 0.35 | | |
| | I | 0.5 | | |
| | TOTAL | 0.85 | 3.2 | 5 |
| Comparative Example | | | | |
| 2(a) | Mg(OAc)2 | 0.7 | | 8 |
| 2(b) | I | 1.0 | | 9 |
| Example 3 | Sr(OAc)2 | 0.5 | | |
| | I | 0.5 | | |
| | TOTAL | 1.0 | 3.2 | 6 |
| Comparative Example | | | | |
| 3(a) | Sr(OAc)2 | 1.0 | | 13 |
| 3(b) | I | 1.0 | | 12 |

TABLE II

| Example | Sealant Composition | Amount (g/l) | Molar ratio[1] | ADT Wt. Loss mg./in.$^2$* |
|---|---|---|---|---|
| 4 | Ca(OAc)2 | 0.9 | | |
| | I | 0.5 | | |
| | TOTAL | 1.4 | 7.4 | 2.8 |
| 5 | Ca(OAc)2 | 0.9 | | |
| | I | 0.9 | | |
| | TOTAL | 1.8 | 4.1 | 3.1 |
| 6 | Ca(OAc)2 | 1.9 | | |
| | I | 0.5 | | |
| | TOTAL | 2.4 | 15.6 | 2.8 |
| 7 | Ca(OAc)2 | 2.8 | | |
| | I | 0.9 | | |
| | TOTAL | 3.7 | 12.7 | 1.5 |

*Average of two runs

[1]Molar ratio of alkaline earth metal salt to compound I. (Gram molecular weight of Compound I is based on weighted average molecular weight of compound in 80:20 mixture of monoalkylated to dialkylated compounds.)

What is claimed is:

1. An aqueous sealant composition comprising a solution of at least one soluble alkaline earth metal salt and at least one compound of formula I

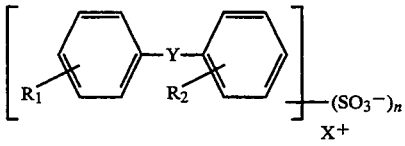

I wherein

Y is a direct bond or a group of formula

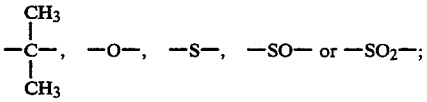

$R_1$ and $R_2$ are each individually selected from H or $C_5$–$C_{25}$alkyl, provided that $R_1$ and $R_2$ may not both be H;

n has a value in the range of 1 to 4; and $X^+$ is a counterion, wherein said alkaline earth metal salt and compound of formula I are in a molar ratio of about 2:1 to 20:1.

2. A sealant composition according to claim 1 wherein the compound of formula I is selected from compounds wherein Y is O; n is 1 or 2; and $R_1$ and $R_2$ are each para to a phenyl group.

3. A sealant composition according to claim 2 wherein the compound of formula I is selected from compounds wherein at least one of $R_1$ and $R_2$ is $C_{12}$–$C_{20}$alkyl, and the sulfonate group or groups is ortho to the Y group.

4. A sealant composition according to claim 3 wherein the compound of formula I is selected from compounds wherein n is 2, and at least one of $R_1$ and $R_2$ is $C_{14-16}$alkyl.

5. A sealant composition according to claim 4 wherein the compound of formula I is selected from compounds wherein at least one of $R_1$ and $R_2$ is $C_{16}$alkyl.

6. A sealant composition according to claim 5 wherein the alkaline earth metal salt is selected from calcium acetate, magnesium acetate, and mixtures thereof.

7. A sealant composition according to claim 2 wherein the alkaline earth metal is selected from magnesium, calcium, and mixtures thereof.

8. A sealant composition according to claim 7 wherein the salt of the alkaline earth metal is selected from acetates, sulfates, hydroxides, nitrates, halides, sulfamates, and mixtures thereof.

9. A sealant composition according to claim 7 wherein the alkaline earth metal salt and the compound of formula I are in a molar ratio of about 4:1 to about 20:1.

10. A sealant composition according to claim 9 wherein the alkaline earth metal salt and the compound of formula I are in a molar ratio of about 10:1 to about 16:1.

11. A sealant composition according to claim 2 wherein the alkaline earth metal salt and the compound of formula I are in a molar ratio of 4:1 to 20:1.

12. A sealant composition according to claim 11 wherein the alkaline earth metal salt and the compound of formula I are in a molar ratio of 10:1 to 16:1.

13. A sealant composition according to claim 12 wherein the alkaline earth metal salt and the compound of formula I are in a weight ratio of 1:1 to 10:1.

14. A sealant composition according to claim 2 wherein the alkaline earth metal salt and the compound of formula I are in a weight ratio of 1:1 to 10:1.

15. A sealant composition according to claim 1 wherein the alkaline earth metal salt is selected from calcium acetate, magnesium acetate, and mixtures thereof.

16. A sealant composition according to claim 1 wherein the alkaline earth metal salt is selected from magnesium acetate, calcium acetate, and mixtures thereof, and the compound of formula I is as follows:

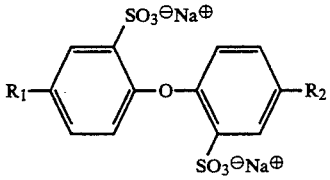

wherein each of $R_1$ and $R_2$ is either H or $C_{16}$alkyl, provided that $R_1$ and $R_2$ may not both be H.

17. An aqueous sealant composition according to claim 1 which is a concentrate comprising about 400–800 grams/liter of the combined alkaline earth metal salt and compound of formula I.

18. A sealant composition according to claim 1 having a pH of 4.5 to 7.5.

19. An aqueous sealant composition comprising a solution of at least one water-soluble salt of an alkaline earth metal selected from calcium, magnesium, and mixtures thereof, and at least one compound of the following formula I(a):

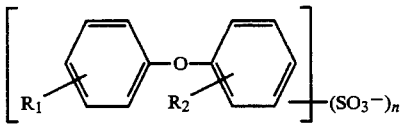

I(a)

wherein $R_1$ and $R_2$ are each individually selected from H or $C_5$–$C_{25}$alkyl provided that $R_1$ and $R_2$ may not both be H;

n has a value in the range of 1 to 4; and $X^+$ is a counterion, wherein said alkaline earth metal salt and compound of formula I(a) are in a molar ratio of about 2:1 to 20:1.

20. A sealant composition according to claim 19 wherein the alkaline earth metal salt and compound of formula I(a) are in a molar ratio of 4:1 to 20:1.

21. A sealant composition according to claim 19 wherein the alkaline earth metal salt and compound of formula I(a) are in a molar ratio of 10:1 to 16:1.

22. A composition according to claim 21 wherein n is 1 or 2; and $R_1$ and $R_2$ are each para to the O atom.

23. A composition according to claim 22 wherein at least one of $R_1$ and $R_2$ is $C_{12}$–$C_{20}$alkyl, and the sulfonate group or groups is ortho to the O atom.

24. A sealant composition according to claim 22 wherein the alkaline earth metal salt and the compound of formula I(a) are in a weight ratio of 3:1 to 5:1.

25. A sealant composition according to claim 24 wherein the alkaline earth metal salt is selected from magnesium acetate, calcium acetate, and mixtures thereof.

26. A sealant composition according to claim 25 wherein the alkaline earth metal salt comprises magnesium acetate.

27. A sealant composition according to claim 19 which is free of added nickel or cobalt.

28. A sealant composition according to claim 19 wherein the alkaline earth metal salt and the compound of formula I(a) are in a weight ratio of 0.5:1 to 15:1.

29. A sealant composition according to claim 28 wherein the alkaline earth metal salt and the compound of formula I(a) are in a weight ratio of 1:1 to 10:1.

30. A sealant composition according to claim 19 wherein at least one of $R_1$ and $R_2$ is $C_{12}$–$C_{20}$alkyl.

31. A sealant composition according to claim 30 wherein the alkaline earth metal salt and the compound of formula I(a) are in a weight ratio of 1:1 to 10:1.

32. A sealant composition according to claim 31 wherein the alkaline earth metal salt is selected from magnesium acetate, calcium acetate, and mixtures thereof.

33. A sealant composition according to claim 32 wherein the alkaline earth metal salt comprises magnesium acetate.

* * * * *

UNITED STATES PATENT AND TRADEMARK OFFICE

CERTIFICATE OF CORRECTION

PATENT NO. : 5,362,317

DATED : November 8, 1994

INVENTOR(S) : PATEL et al.

It is certified that error appears in the above-indentified patent and that said Letters Patent is hereby corrected as shown below:

Column 8, line 5, after 20:1, insert --and the weight ratio of the alkaline earth metal salt to the compound of formula I is about 0.1:1 to 30:1--.

Column 9, line 42, after 20:1, insert --and the weight ratio of the alkaline earth metal salt to the compound of formula I is about 0.1:1 to 30:1--.

Signed and Sealed this

Fifteenth Day of September, 1998

*Attest:*

Bruce Lehman

BRUCE LEHMAN

*Attesting Officer*

*Commissioner of Patents and Trademarks*